United States Patent [19]

Douglass, Jr.

[11] 4,341,052

[45] Jul. 27, 1982

[54] BUILDING UTILITY CORE

[76] Inventor: John C. Douglass, Jr., 863 Ave. Acapulco, San Clemente, Calif. 92672

[21] Appl. No.: 160,425

[22] Filed: Jun. 17, 1980

[51] Int. Cl.[3] ..... E04B 5/48

[52] U.S. Cl. ..... 52/742; 52/220

[58] Field of Search ..... 52/35, 220, 221, 79.1, 52/169.1, 742, 234, 169.2, 126; 137/358, 356, 362

[56] References Cited

U.S. PATENT DOCUMENTS 2,168,725 8/1939 Whelan ..... 52/35

2,562,050 7/1951 Lankton .

3,742,666 7/1973 Antoniou ..... 52/79.1

*Primary Examiner*—John E. Murtagh

[57] ABSTRACT

An improved method of constructing residential buildings incorporates a utility core or compartment, the outer walls of which are common to selected rooms of the building. The water, sewer, and gas piping systems are located in the utility core, and may be connected to fixtures within the building by appropriate piping and conduit extending directly through the common walls, rather than built into the walls through the foundation or through the floor of the building. The utility core may be formed to accommodate differing floor plans and is located to be accessible from the exterior of the building.

3 Claims, 5 Drawing Figures

BUILDING UTILITY CORE

BACKGROUND OF THE INVENTION

The present invention relates generally to the residential construction industry, and more particularly to an improved method of constructing residential buildings wherein the utility intensive rooms of the structure are clustered about and share a common wall with a central utility core or compartment. All piping serving water, sewer, and gas to the various fixtures within the structure extend directly through the common walls of the utility core and are interconnected within the interior of the utility core to form composite water, sewage, and gas piping systems.

In an effort to reduce the rising costs of residential buildings, the construction industry has focused upon improved methods of construction which attempt to minimize the raw material and labor costs of the completed structure. One widely utilized cost reducing construction technique has been the use of concrete slab on grade floors instead of costly raised wood floor and joist structures.

As is well known in the art, prior to pouring such concrete slabs, incoming water and gas lines, and outgoing drain or sewer lines, are emplaced in trenches formed on the site to extend to various room locations within the building. Typically, these lines terminate at "stub-ups" in various locations of the building, which protrude upward, being raised slightly above the final elevation of the concrete slab. The concrete slab is then poured over the water, sewer, and gas lines with the subsequent mudsill/stud framing building techniques usually being utilized to complete the structure. Although such current construction techniques have proven to be more economical than the prior art floor joist/raised sub-floor building techniques, there remains substantial material and labor costs for the trenching and emplacement of the water, sewer, and gas lines upon the site and within the walls of the building. In both small and large floor plan structures alike, the plumbing and gas fixtures which are dictated by room layouts (such as kitchen and bathroom locations) are often separated by significant distances typically ranging up to 50 to 100 feet, thereby requiring substantial trenching and the use of long piping lengths during construction. In addition, these long trenches and piping must be accurately positioned on the site to ensure proper location of the stub-ups in relation to later formed interior and exterior walls of the structure.

Further, the current concrete foundation and floor slab construction method is fraught with substantial time scheduling problems, requiring initial water, sewer, and gas line installation to be completed prior to the pouring of the concrete foundation and floor slab, rough plumbing (i.e., pipe connections within the walls) to occur after wall framing, and finished plumbing (i.e., fixture hook-up) to be completed subsequent to interior wall surfacing and cabinet installation. As such, the water, sewer, and gas system construction personnel have been required to make multiple visits to the construction site at specific times corresponding to the various construction phases of the building. Due to the predominant use of independent contractors for most of these separate construction components (i.e., plumbing, framing, wall surfacing, and cabinetry), construction delays encountered during any one of the separate construction components cause corresponding delays in all of the following construction components, thereby substantially increasing overall construction costs. Additionally, these separate construction components additionally subject the water, sewer, and gas piping systems to a substantial risk of damage with water and sewer stub-ups often being crushed, crimped, or perforated during the subsequent framing process.

In addition, such prior art construction techniques have typically failed to provide any convenient means for modification of the finished water, sewer, and gas piping systems or repair of faulty piping systems emplaced beneath the concrete foundation slab or in the wall of the building. Such failure can permit piping system leakage to remain undetected for a substantial period of time and require costly cutting and tear up of the concrete foundation and/or floor to gain access to the buried piping.

Although these deficiencies have been recognized to a limited extent in the patent art, with some modern building methods providing a clustering of plumbing utilities in a localized area of the building, or portable prefabricated utility units, such as those disclosed in Lankton, U.S. Pat. No. 2,419,319 and U.S. Pat. No. 2,562,050, such attempts still require incoming water and main lines to be buried in a precise location beneath a portion of the floor and additionally severely limit the available floor plan design options of the building. Further, none of these prior art attempts have provided a readily accessible, permanently exposed, common utility area which accommodates repair, subsequent modification, or replacement of the water, sewer, and piping systems. Hence, there exists a substantial need in the art for an improved method of construction which takes advantage of the cost savings associated in concrete slab construction, while minimizing material and labor wastage, reducing construction phase scheduling, eliminating the susceptibility of damage to the water, sewer, and gas piping systems throughout and readily accommodating maintenance repair and modification of the piping systems of the building.

SUMMARY OF THE PRESENT INVENTION

The present invention specifically addresses and alleviates the above-referenced deficiencies associated in the art by providing an improved method of constructing residential buildings which incorporates a utility core or central utility compartment in which all of the water, sewer, and gas piping systems are located. The outer walls of the utility core are shared, and form common walls with selected rooms of the structure, such as kitchens and bathrooms, where utility usage, and in particular, water, sewer, and gas usage, is predominant. Due to this common or shared wall construction, piping and conduit material costs are reduced to a minimum and appropriate connections to the utility fixtures within the structure may be readily accommodated directly through the common wall, rather than through the floor or within the walls of the building, and with the finished piping systems being permanently exposed adjacent the walls of the utility core.

The utility core is preferably formed as a recess or indentation in the concrete floor slab of the structure initiating at an exterior wall, and may assume any given dimensions or shape to accommodate flexibility in building floor plan design. Due to the water, sewer, and gas piping systems being located within the utility core and accessible from a location exterior to the structure, the concrete slab, rough framing, wall surfacing, and finished cabinetry may be completed prior to the initiation of any water, sewer, or gas piping installations. Thus, the scheduling problems and separate multiple visits of the water, sewer, and gas construction personnel heretofore associated in the art have been eliminated, with the entire piping installation being accommodated during one general time period. Further, the possibility of damage or blockage of "stub-ups" and rough piping lines during the construction of the building has been eliminated.

In addition, due to the water, sewer, and gas piping systems being localized and exposed within the utility core itself, detection of leaks and subsequent repair or modification of piping systems of the structure may be readily accommodated in an accessible, single area. Further, the utility core of the present invention may advantageously house the waterheater, forced air furnace, air conditioning unit, and in some instances, a clothes washer and dryer, whereby if accidental leakage develops in the piping of these units, the interior of the building structure is isolated from damage with any water being directed outward through the entrance to the utility core.

BRIEF DESCRIPTION OF THE DRAWINGS

These as well as other features of the present invention will become more apparent upon reference to the drawings, wherein.

DETAILED DESCRIPTION OF THE PREFERRED EMBODIMENT

Figure 1:
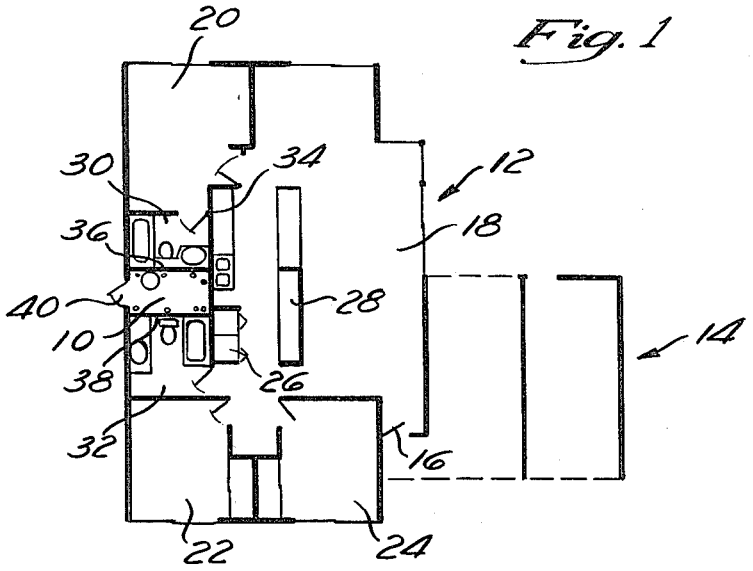
FIG. 1 depicts an exemplary floor plan of a residential building in which the utility core is formed in a rectangular configuration and shares common walls with the bathrooms and kitchen of the building.
Figure 2:
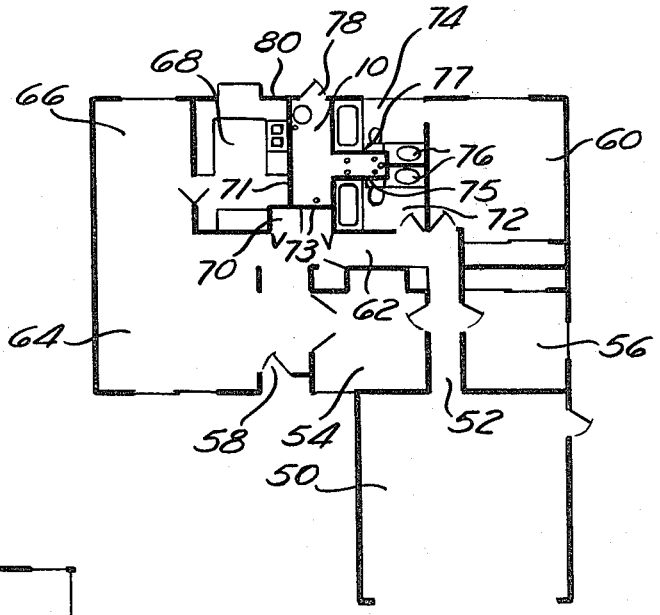
FIG. 2 is an additional floor plan of a residential building wherein a T-shaped utility core is utilized to provide greater flexibility in bathroom and kitchen location within the building.
Figure 3:
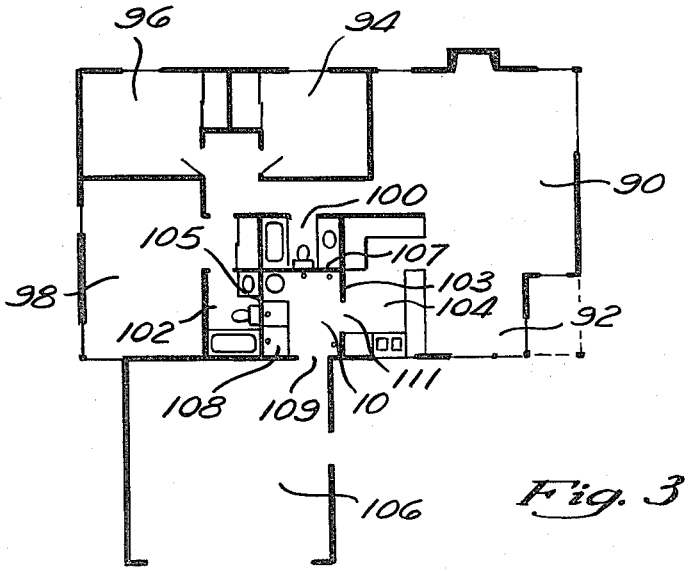
FIG. 3 is an additional floor plan of a residential building wherein the utility core is positioned adjacent to the garage as well as the kitchen of the building.

FIGS. 1 through 3 depict three different floor plans of a residential building utilizing the utility core or compartment 10 of the present invention. The utility core 10, as well as the specific floor plans, may be formed in any desired size and configuration, and the specific configurations illustrated in FIGS. 1, 2, and 3 are disclosed merely by way of example.

FIG. 1 illustrates a residential housing unit, composed generally of a main residence section 12, and an adjoining carport or garage section 14. The residence section 12 includes an entry 16 leading into a combined living room/den 18, and a master bedroom 20, and guest bedrooms 22 and 24 located in the back and front portions, respectively, thereof. A kitchen/laundry area 26 is disposed centrally within the interior of the residence section 12 and is segregated from the combined living room/den 18 by a passthrough or counter/island 28. A master bathroom 30 and guest bathroom 32 adjoin the master and guest bedrooms 20, 22, and 24, respectively.

The utility core 10 of the present invention is positioned between the master and guest bathrooms 30 and 32, and includes an entrance 40 formed in the exterior wall of the residence section 12. As shown, the utility core 10 is thus located adjacent to and shares the common walls 34, 36, and 38, with those rooms of the building containing all of the major water, sewer, and gas fixtures (i.e., the kitchen/laundry area 26, master bath 30, and guest bath 32, respectively).

FIG. 2 illustrates a different residential building floor plan, incorporating the utility core 10 construction of the present invention. The residential floor plan includes an attached garage 50, having a hallway entrance 52, extending between the guest bedrooms 54 and 56. The hallway 52 terminates at the master bedroom 60 and communicates with the central hallway 62, which leads to the living room 64 and kitchen nook 66. As with the floor plan of FIG. 1, the kitchen 68, laundry area 70, hall bathroom 72, and master bathroom 74 are clustered about and share common walls 71, 73, 75, and 77 with the utility core 10 of the present invention. To provide greater flexibility in room location within the structure, the utility core 10 in this floor plan is formed in a substantially T-shaped configuration to extend within close proximity of the washbasins 76, located in the bathrooms 72 and 74. Access to the interior of the utility core 10 is provided by an entrance 78, formed on the rear wall 80 of the residence which additionally facilitates access to incoming utility lines to the utility core 10.

FIG. 3 depicts an additional residential structure floor plan, wherein the utility core 10 is formed to include a larger floor space area and may be utilized as a laundry room and auxillary entrance to the building. As shown, in this residential floor plan, the living room 90 and breakfast nook 92 are disposed on one side of the structure, with the guest bedrooms 94 and 96 and master bedroom 98 being positioned around the perimeter walls of the other side of the structure. As is common to all of the floor plans depicted herein, the major utility using rooms, i.e., the guest bathroom 100, master bathroom 102, and kitchen 104, are clustered about and share common walls 103, 105, and 107 with the utility core 10. In this floor plan embodiment, access into the utility core 10 is provided through an exterior doorway 109 to the attached garage 106, as well as through a doorway 111 formed in the kitchen 104, thereby permitting the utility core 10 to function as an enclosed corridor between the garage 106 and kitchen 104. Due to the relatively enlarged size and location of the utility core 10 in this floor plan, laundry facilities 108 may be readily accommodated within the utility core 10 itself, thereby being isolated from the main living quarters of the residence.

Figure 4:
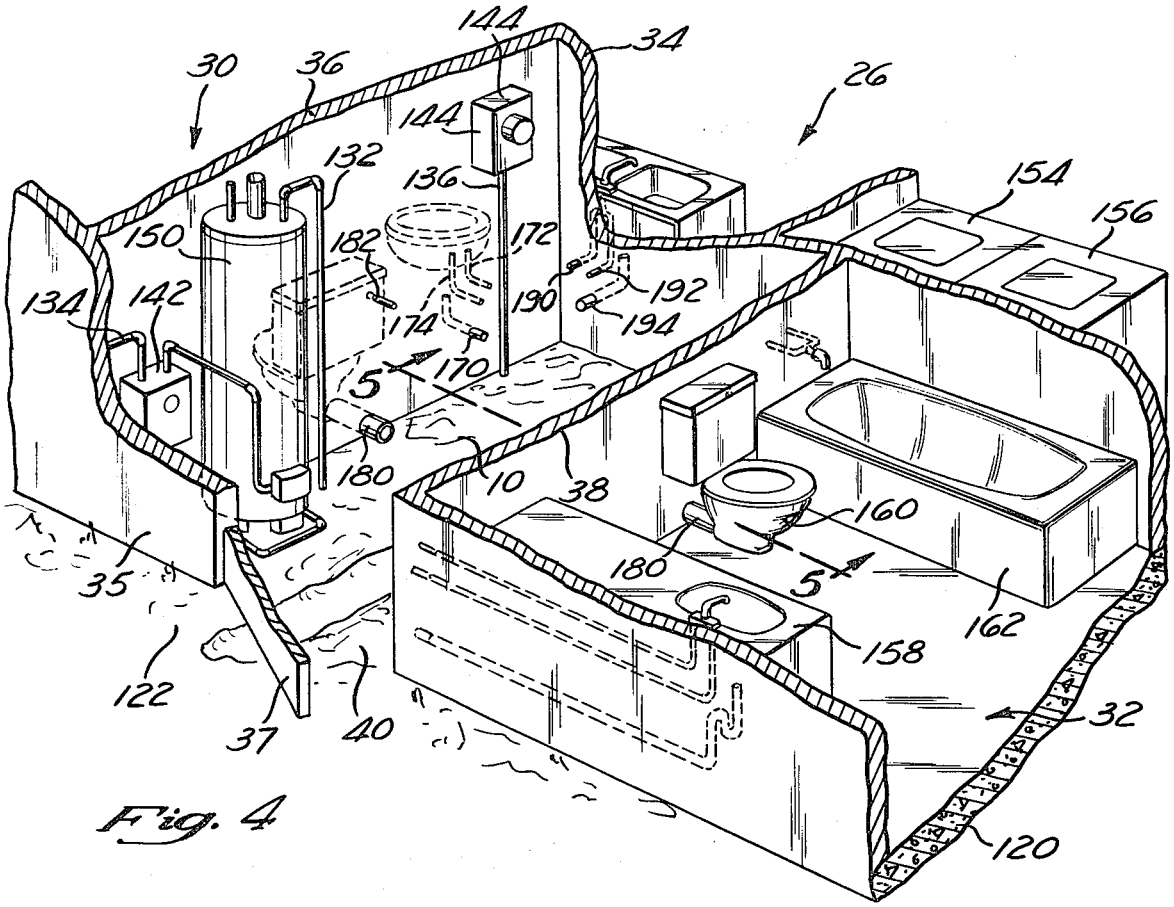
FIG. 4 is a perspective view of the utility core of the present invention partially cut away to illustrate the positioning of the utility core relative the bathrooms and kitchen of a building.
Figure 5:
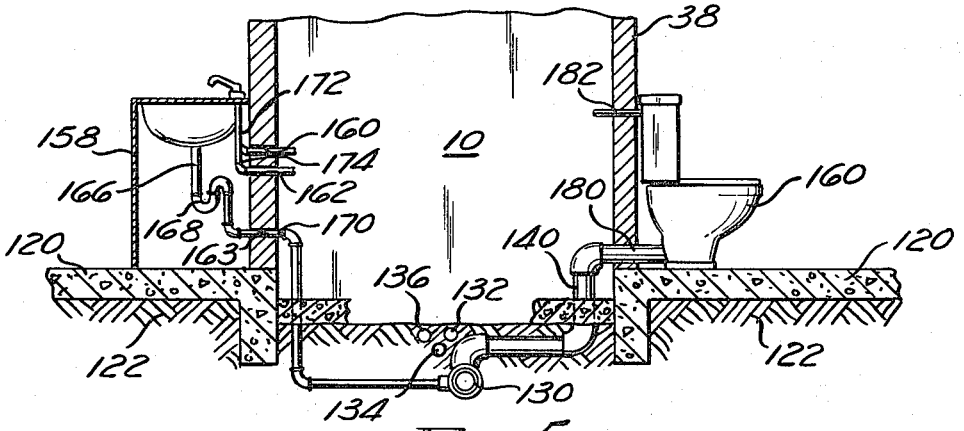
FIG. 5 is a cross-sectional view taken about lines 5—5 of FIG. 4 illustrating the manner in which the various piping extends through the common or shared walls of the utility core and connect with the composite water, sewer, and gas systems located within the utility core.

The detailed construction and substantial cost benefits made possible by the utility core 10 of the present invention may be recognized by reference to FIGS. 4 and 5. The specific utility core 10, depicted therein, corresponds to that illustrated in FIG. 1, however, the similar structure and same construction method described herebelow is applicable to the floor plans illustrated in FIGS. 2 and 3, as well as other various floor plan layouts.

The utility core 10 of the present invention is defined by the walls 34, 36, 38, and 35, which are common to the master bathroom 30, guest bathroom 32, kitchen laundry area 26, and exterior of the building, respectively. An opening 40 is formed in the outer wall 35 to permit access into the interior of the core 10 from outside of the actual building and a door 37 is preferably provided to prevent excessive environment exposure and limit unauthorized entry. The utility core 10 is preferably formed as a recess or indentation in the concrete slab 120 of the structure, which, in this embodiment, possesses a rectangular configuration. Due to this indentation, the flooring of the utility core 10 is formed by the excavation site or ground 122, rather than the concrete slab 120.

As shown in FIG. 5, all of the service entrances, such as the sewer main 130, water main 132, gas main 134, and electrical power line 136, may extend from the exterior of the building directly into the utility core 10, preferably being disposed below ground level. The sewer main 130 typically terminates in a stub-up 140, located within the interior of the core 10, while the incoming water, gas, and electric lines 132, 134, and 136, respectively, extend upward adjacent the common wall 36 and are connected in a conventional manner to an appropriate gas meter 142, electric meter 144, and water meter (not shown). As will be recognized, due to the floor of the utility core 10 being formed by the excavation site or ground 122, and accessed through the opening 40 formed in the exterior wall 35, the various utility mains 130, 132, 134, and 136 may be brought from the exterior of the structure directly into the interior of the core 10 at any time during and preferably after completion of the actual frame and wall construction of the building.

As best shown in FIG. 4, the various utility using devices or fixtures of the bathrooms 30 and 32 and kitchen 26 are located proximal one of the respective common walls 34, 36, and 38 of the utility core 10. Specifically, the kitchen 26 includes a double basin sink 150 and commercial laundry washer and dryer units 154 and 156, positioned adjacent the common wall 34, while each of the bathrooms 30 and 32 include a counter/basin 158, water closet 160, and bath 162, adjacent the respective common walls 36 and 38. Due to this proximal location of the using fixtures, and the various utility mains 130, 132, 134, and 136 being localized within the utility core 10, final fixture connections can be made directly through the common walls 34, 36, and 38, rather than through the slab 120, as heretofore utilized in the art.

The particular manner in which the various fixtures are connected through the common walls 34, 36, and 38 of the utility core 10 is illustrated in FIG. 5. Initially, a plurality of holes 160, 162, and 163 are cut through a respective common wall 36 in an area adjacent to and disposed below the bathroom counter/basin 158. Finished drain plumbing, such as a drop tube 166, trap 168, and drainpipe 170, are then connected to the basin drain in a conventional manner with the drainpipe 170 extending through the aperture 163 and terminating within the interior of the utility core 10. Similarly, incoming water lines 172 and 174 are connected in a well known manner to the basin faucet 176 and passed through the appropriate apertures 160 and 162 to extend into the utility core 10. In an analogous manner, the finished drain line 180 and water line 182 may be connected to the water closets 160 and extend through the common wall 38, whereas additional incoming water lines 190, 192, and drain lines 194 may be connected to the double basin sink 150 and laundry washer/dryer units 154 and 156 through the common wall 34.

With the finished piping extending through all of the common walls 34, 36, and 38 and into the interior of the utility core 10, conventional water, drain, and gas piping may be utilized to form appropriate manifolds (not shown) to interconnect respective hot and cold water pipes, drain pipes, and gas pipes, with the water main 132, gas main 134, and sewer main 130, such that composite water, sewer, and gas systems are formed. As will be recognized, the composite water, sewer, and gas systems are permanently, visually exposed within the interior of the utility core 10, preferably extending proximal to the common walls 34, 36, and 38, to provide the least obstruction within the interior of the utility core 10. As such, visual inspection of water and gas leaks, as well as any needed repair, can be easily accomplished within the utility core 10 without any need to damage or disturb the actual walls or foundation of the structure.

Those skilled in the art will recognize that by use of the utility core 10 of the present invention, the entire building structure may be completed, including the pouring of the slab, rough framing, wall surfacing, finished cabinetry, and even painting, prior to initiating water, sewer, and gas piping systems installation within the structure, with the piping installation being facilitated with ease of human access and without adversely influencing the previously finished building structure. Similarly, once the piping installation has been completed, the earth floor of the utility core may be covered with a concrete slab, preferably maintained at an elevation a few inches below the slab floor to prevent water/mud accumulation within the core and any water being directed outward through the exterior entrance to the utility core. Hence, the scheduling problems heretofore associated in the prior art are substantially reduced. Further, due to the fixtures within the residence being clustered about the utility core 10, and the composite water, sewer, and gas piping systems being centralized within the utility core, material and labor costs are held to a minimum. In addition, when subsequent plumbing or gas problems arise, the source of the problem may be readily recognized, and needed repairs can be easily initiated within the readily accessible interior of the core 10. Further, although the utility core 10 has been disclosed herein in relation to single-story structures, it will be recognized that the present invention is readily adaptable to multi-story buildings with each floor in the structure including a localized utility core area, or a single core extending up for more than one story.

What is claimed is:

1. An improved method of constructing a residential structure, comprising:

pouring a concrete slab on the ground at a building site to form the floor of several rooms within the perimeter of said residential structure, and to form a recessed area within said perimeter at which concrete is not poured in which said ground forms the floor;

erecting on site the walls and roof of said several rooms to arrange utility intensive rooms around said recessed area, the walls of said utility intensive rooms at least partially enclosing said area;

before or after pouring said slab extending main service utility connections below the ground into said area;

extending piping through said walls enclosing said area and connecting it to one or more fixtures disposed in said utility intensive rooms;

connecting said piping to said main service utility connections in said area; and after completion of the building said piping being readily accessible from the interior of said area.

2. The method of claim 1 wherein said step of extending piping through said walls comprises:

forming a plurality of apertures through at least some of said walls enclosing said area at a location substantially aligned with said one or more of said fixtures;

inserting piping through each of said plurality of apertures; and connecting said piping to said fixtures.

3. A method in accordance with claim 1, wherein said step of extending main service utility connections comprises:

after said slab is poured, digging a trench from outside said slab into said area and installing said main service utility connections for said building to said area through said trench.

* * * * *